US006478642B1

(12) United States Patent
Kolb et al.

(10) Patent No.: US 6,478,642 B1
(45) Date of Patent: Nov. 12, 2002

(54) OIL SYSTEM WITH REPLACEABLE OIL FILTER FOR TWO-CYCLE ENGINES

(75) Inventors: Richard P. Kolb, Prairieview, IL (US); David J. Hartke, Gurnee, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/689,369

(22) Filed: Oct. 12, 2000

(51) Int. Cl.[7] ..... B63H 21/10; F01M 1/00; F02B 33/04

(52) U.S. Cl. ..... 440/88; 123/73 AD; 123/196 A

(58) Field of Search ..... 123/73 AD, 196 A, 123/196 R; 184/6.24, 7.4; 440/88

(56) References Cited

U.S. PATENT DOCUMENTS 4,426,965 A * 1/1984 Patel ..... 123/196 AB
4,576,126 A 3/1986 Ancheta ..... 123/41.38
4,708,674 A * 11/1987 Matsumoto ..... 440/88
4,969,848 A * 11/1990 Isogawa ..... 440/77
5,149,287 A * 9/1992 Koike ..... 440/88
5,235,944 A * 8/1993 Adachi ..... 123/196 R
5,327,862 A * 7/1994 Bedi ..... 123/196 R
5,355,851 A * 10/1994 Kamiya ..... 123/196 R
5,366,400 A * 11/1994 Kucik ..... 440/88
5,511,524 A * 4/1996 Kidera et al. ..... 123/196 R
5,941,745 A * 8/1999 Kanno ..... 440/88
5,984,742 A 11/1999 Kimura et al. ..... 440/77

* cited by examiner

*Primary Examiner*—S. Joseph Morano
*Assistant Examiner*—Andy Wright
(74) *Attorney, Agent, or Firm*—Timothy J. Ziolkowski

(57) ABSTRACT

An oil system for a two-stroke outboard marine engine is disclosed. The oil system includes an oil system housing having an inlet, an outlet, and an oil return. The housing includes an oil filter base to receive a replaceable oil filter thereon. The oil is routed in a closed loop that includes an oil reservoir, the inlet to the oil system housing, through the replaceable oil filter, and is then returned to the oil reservoir. Periodically, a solenoid opens the closed loop system to divert oil to the two-stroke engine, at which time a remote vent valve is activated to allow air to enter the oil reservoir to displace the dispensed oil.

26 Claims, 9 Drawing Sheets

TO ENGINE CYLINDERS
FUEL SYSTEM
MANIFOLD
AIR IN
FILTER
PRESSURE SENSOR
PRESSURE REGULATOR
ECU
OIL TANK
PUMP
FILTER

OIL SYSTEM WITH REPLACEABLE OIL FILTER FOR TWO-CYCLE ENGINES

BACKGROUND OF THE INVENTION

The present invention relates generally to oiling systems for internal combustion engines, and more specifically, to an oiling system for a two-cycle/two-stroke engine having a replaceable oil filter.

Typically, two-stroke outboard marine engines do not have a separate oiling system. That is, these prior art engines require pre-mixing lubricant and fuel so that the lubricant dissolves in the fuel to lubricate the engine. This requires consistent, accurate measuring and agitation of the mixture. There are many disadvantages to the prior art system of pre-mixing lubricant and fuel. For example, since various two-stroke engines require different mix concentrations, many outboard marine engine owners also own other two-stroke engine equipment, such as various lawn and garden equipment and ATV's, they may store several different concentrations of oil/fuel mixture. This is not only an aggravation to the owner, but is also problematic if the containers become mixed up and the owner uses the wrong concentration for a particular two-stroke engine. While this is not catastrophic, if run over time with the wrong concentration, a two-stroke engine can wear excessively.

The present invention is for use in a unique lubrication system for two-stroke engines. Such a lubrication system must not only provide lubrication to each cylinder of the engine, it must also provide lubrication to the fuel system to properly lubricate the fuel metering and injection system. Unlike four-stroke engines which are designed to not consume oil but only to re-circulate oil for lubrication, a two-stroke engine, by its nature, consumes oil during use. It has generally been believed that since the oil is consumed by the two-stroke engine, that careful metering of the oil directly to the engine does not need filtering. However, many problems can occur in such a precise metering system. Therefore, it would be advantageous to have a pressurized closed loop oil re-circulation system that periodically diverts oil to the engine. In such an oiling system, it would be advantageous to provide filtering of the oil in the re-circulation system to remove any contaminants that may enter the oil.

SUMMARY OF THE INVENTION

The present invention discloses an oil system with a replaceable oil filter that solves the aforementioned problems.

In accordance with one aspect of the invention, an outboard motor includes a two-stroke internal combustion engine and a water propulsion unit in operable association with the two-stroke engine to propel the outboard motor through the water. The outboard motor includes an automatic oil injection system to lubricate the two-stroke engine. The outboard motor also includes an oil system housing having an oil inlet, an oil outlet, and a replaceable oil filter threadedly engaged to the oil system housing to filter lubricant received from the oil inlet.

In accordance with another aspect of the invention, an oil system for a two-stroke engine includes an oil system housing having an oil inlet, an oil outlet, and oil return, and a threaded stud extending from the oil system housing. A replaceable oil filter is threadedly engaged to the threaded stud of the oil system housing to filter lubricant that is recycled through the oiling system and supplied to the two-stroke engine. The oiling system includes a remotely located oil reservoir and an oil pump to pump lubricant to the oil inlet and through the replaceable oil filter.

The invention includes an oil system housing that includes an oil inlet port in communication with a first internal passage, and an oil filter base to replaceably receive an oil filter thereon such that lubricant from the first internal passage is directed into the oil filter and returned to a second internal passage of the oil system housing. The housing further includes an oil return port in communication with a third internal passage of the oil system housing. An oil outlet port is provided in communication with a fourth internal passage of the housing. The housing includes a solenoid chamber to receive a solenoid therein to toggle lubricant flow from the second internal passage to one of the third and fourth passages. When the solenoid is not activated, oil is routed through a closed system that includes the oil filter. When the solenoid is activated, oil is still routed through the filter, but is then diverted to the two-stroke engine.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figures 1, 2:
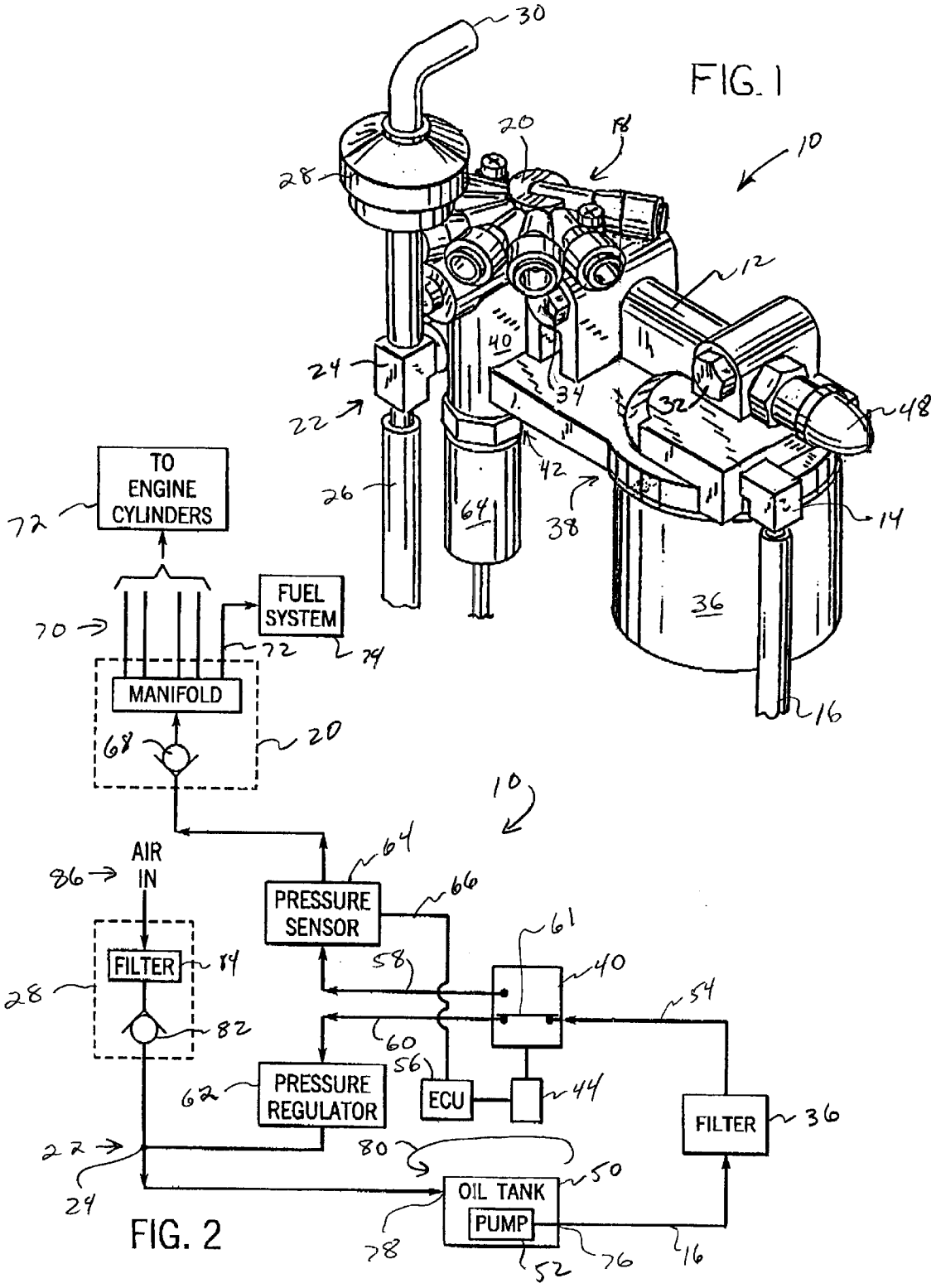
FIG. 1 is a perspective view of an oiling system for a two-stroke outboard marine engine.
FIG. 2 is a schematic illustration of an oiling system in accordance with one aspect of the present invention.

Referring to FIG. 1, an oiling system 10 is shown, preferably for a two-stroke engine of an outboard marine motor. The oiling system 10 includes an oil system housing 12 having an oil inlet 14 connected to a supply line 16. The oiling system housing 12 also includes an oil outlet 18 that supplies oil to a distribution manifold 20. A separate oil return 22 is provided through a tee-connector 24 connected to the oil system housing 12 and a return line 26 to return unused oil to an oil reservoir. The tee-connector is also connected to a vent valve 28 that is open on one end 30 to atmospheric pressure.

The oil system housing 12 is mounted to an engine with mounting bolts 32, 34 and is constructed to receive a full flow, replaceable oil filter 36 on an oil filter base 38 to filter incoming pressurized oil from supply line 16 through oil inlet 14. The pressurized oil is then routed through internal passages to an oil flow control section 40 of the oil system housing 12. The oil flow control section 40 is controlled by a solenoid (not shown in FIG. 1) that controls whether oil flows through the oil outlet 18 and distribution manifold 20 or through the oil return 22 and return line 26. The oil system housing 12 also includes a test port 48 that is in fluid communication with an output side of the replaceable oil filter 36 to measure oil pressure during operating conditions. The housing 12 also includes a sensor chamber 42 to receive an oil pressure sensor 64 therein.

Referring to FIG. 2, a schematic representation of an oiling system 10 in accordance with the present invention is illustrated. The oil system includes an oil tank/reservoir 50 having an oil pump 52 associated therewith to pump oil through supply line 16 and filter 36. In a preferred embodiment, as shown in FIG. 2, the oil pump 52 is located inside the oil tank 50. After the oil is filtered, it is routed through an internal passage 54 of the oil system housing 12 to the oil flow control section 40 wherein the flow of oil is controlled by operation of solenoid 44, which in turn is controlled by an electronic control unit (ECU) 56. As previously indicated, the solenoid 44 toggles the flow of lubricant from internal passage 54 to internal passages 58 and 60. When the solenoid 44 is not activated, the normally open position 61 relays oil from the internal passage 54 to the internal passage 60 of the oil system housing 12 through an internal pressure regulator 62 and returns unused oil to the oil reservoir 50.

When solenoid 44 is activated, the flow of oil is diverted to internal passage 58 to supply oil to the distribution manifold 20. A pressure sensor 64 is in fluid communication with the lubricant in internal passage 58 to monitor the lubricant pressure and provide an oil pressure signal 66 to the ECU 56. The distribution manifold 20 includes an internal check valve 68 to prevent the backflow of oil in the oil system 10. The distribution manifold 20 has a number of cylinder oiling outlets 70 that coincide with a number of cylinders of an engine 72, and each oiling outlet 70 is connected to a cylinder of engine 72. The distribution manifold 20 also includes a fuel system oiling outlet 72 to supply lubricant to the fuel system 74, preferably, to lubricate a fuel injection distribution system, and purge air from the oil system through a fuel separator in the fuel system 74.

The oil reservoir 50 of oil system 10 includes an oil supply outlet 76 and an oil supply return 78 and is free of any internal ventilation mechanism. In this manner, the oil reservoir 50 can be completely submerged in water, and as long as the fill cap is properly closed, water cannot enter the oil reservoir.

When solenoid 44 is not activated, a closed loop 80 is formed in the oil routing system between the ventless oil reservoir 50, the filter 36, the oil flow control section 40, through internal passage 60, and the oil return 22. As long as no oil is withdrawn from the reservoir, by the activation of solenoid 44, the oil circulates through the closed loop 80. However, when the loop is open by solenoid 44 to divert lubricant from internal passage 60 to internal passage 58 in the oil flow control section 40, oil is then consumed in the engine 72 and the fuel system 74. This consumption of oil must be displaced or the oil reservoir 50 will come under an increasing negative pressure. Accordingly, the vent valve 28 is coupled to the closed loop 80 at one end of the tee-connector 24 at the oil return 22. Vent valve 28 is a vacuum controlled vent valve and includes a check valve 82 that preferably opens at approximately 3" of $H_2O$ to allow air to displace the consumed oil in the oil reservoir 50 when the solenoid valve 44 periodically diverts lubricant to engine 72. The vent valve 28 also includes a filter 84 to filter contaminates that may be drawn from the atmosphere 86.

Accordingly, a method of venting an oil reservoir 50 of an outboard motor is disclosed that includes providing a ventless oil reservoir, routing lubricant from the ventless oil reservoir 50 through an oil pump 52, to an oil system 10 and back to the ventless oil reservoir 50 in a closed loop 80. The method includes periodically opening the closed loop 80 in the oil system 10 to draw unused lubricant from the ventless oil reservoir. The method also includes providing a vent valve 28, remote from the ventless oil reservoir 50, and at an elevation higher than that of the ventless oil reservoir. The vent valve then automatically opens when lubricant is consumed to displace the consumed lubricant with air in the ventless oil reservoir.

Figure 3:
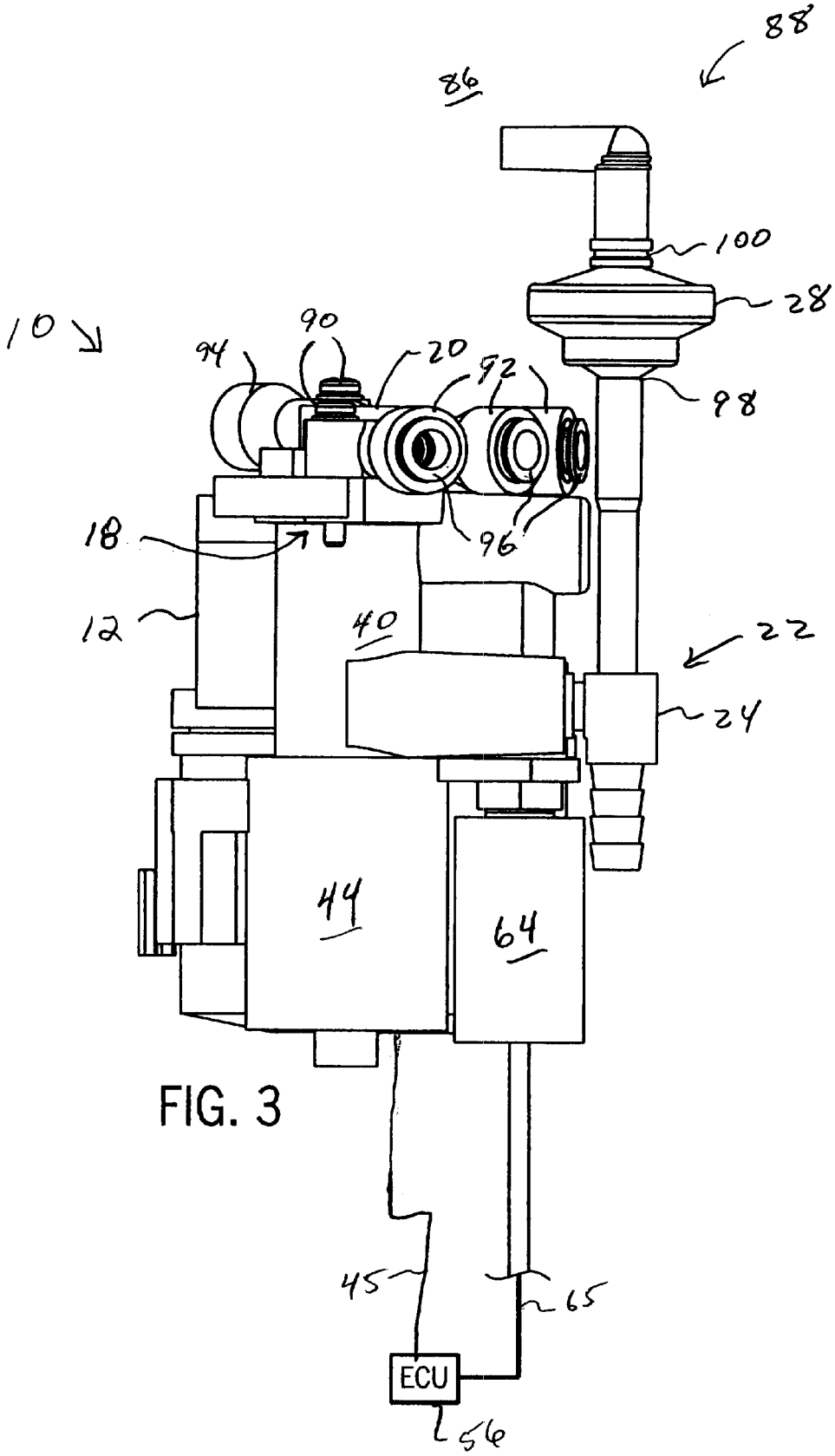
FIG. 3 is a left side, elevational view of the oiling system of FIG. 1 connected to an ECU of an outboard motor.

Referring to FIG. 3, a left side view of the oil system 10 and the oil system housing 12 of FIG. 1 shows the ventilation system 88, the distribution manifold 20, and the solenoid 44 and the pressure sensor 64 connected to the ECU 56 by lead wires 45, 65. The distribution manifold 20 is mounted to the housing 12 over the oil outlet 18 by mounting bolts 90. When oil is diverted by solenoid 44, it is routed through oil outlet 18 to a plurality of cylinder outlet housings 92 and a fuel system oiling outlet housing 94, each of which is equipped with a push-to-connect fitting 96 to allow quick connection and disconnection of the oiling lines that extend to each cylinder and the fuel system. As is indicated in FIG. 3, the fuel system oiling outlet housing 94 is at a higher elevation than each of the cylinder oiling outlets 92 to purge any air from the oiling system through a fuel separator in the fuel system.

The ventilation system 88 preferably includes a diaphragm vent valve 28. The vent valve 28 includes two ends 98, 100, wherein a first end 98 is in communication with the oil return 22 via the tee-connector 24 of the oil system housing 12. The second end 100 is open to the atmosphere 86 to draw air therefrom when solenoid 44 is activated by ECU 56.

Figure 4:
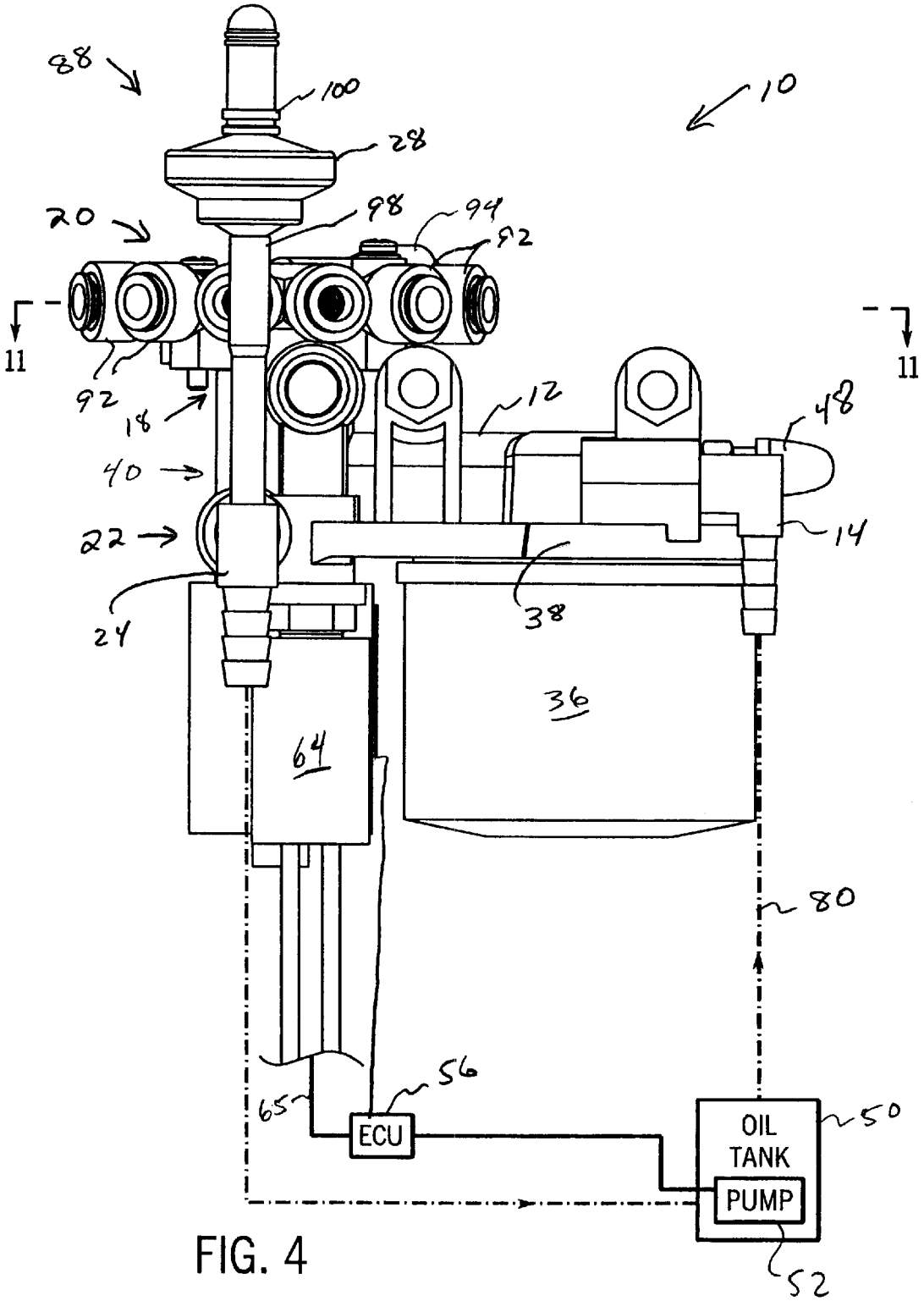
FIG. 4 is a front elevational view of the oiling system of FIG. 1 connected to an ECU and oil tank for an outboard motor.

FIG. 4 shows a front elevational view of the oiling system 10 of FIG. 1 connected schematically to the closed loop default flow path 80. As indicated, lubricant is pumped from the oil reservoir 50 by pump 52 and circulates through the closed loop system 80 all the while that solenoid 44 is not activated by the ECU 56, which also controls the oil pump 52. In this manner, oil is circulated from the oil reservoir 50 through the oil inlet 14, through the replaceable oil filter 36 and is routed in the oil flow control section 40 to the oil return 22, out the tee-connector 24, and back to the oil reservoir 50. When the solenoid 44 is activated by the ECU 56, oil is then diverted from the oil return 22 to the oil outlet 18 and out the distribution manifold 20 to each of the engine cylinders and the fuel system. As oil is consumed, the oil reservoir comes under a negative pressure and draws air through the ventilation system 88.

According to one aspect of the invention, the aforementioned system is incorporated into a two-stroke engine of an outboard motor that includes the oil system housing 12 having an oil filter base to replaceably receive an oil filter 36 thereon such that lubricant in the closed loop system 80 can be continuously filtered, and filtered before consumption by the two-stroke engine.

Figure 5:
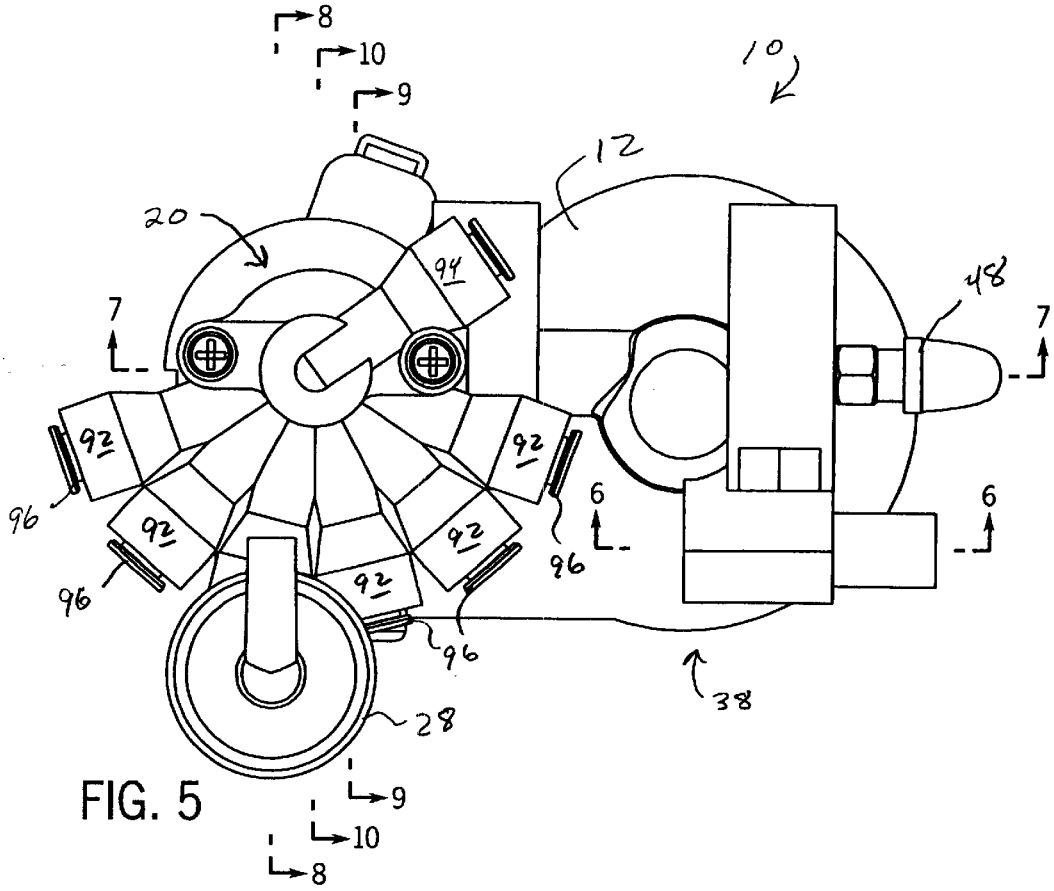
FIG. 5 is a top plan view of the oiling system of FIG. 4.

FIG. 5 shows a top plan view of the oiling system 10 of FIGS. 1, 3 and 4. FIG. 5 shows a top view of the distribution manifold 20 and the diaphragm vent valve 28. FIG. 5 is used to illustrate the cross-section views for FIGS. 6–10 that illustrate the oil flow paths through housing 12.

Figure 6:
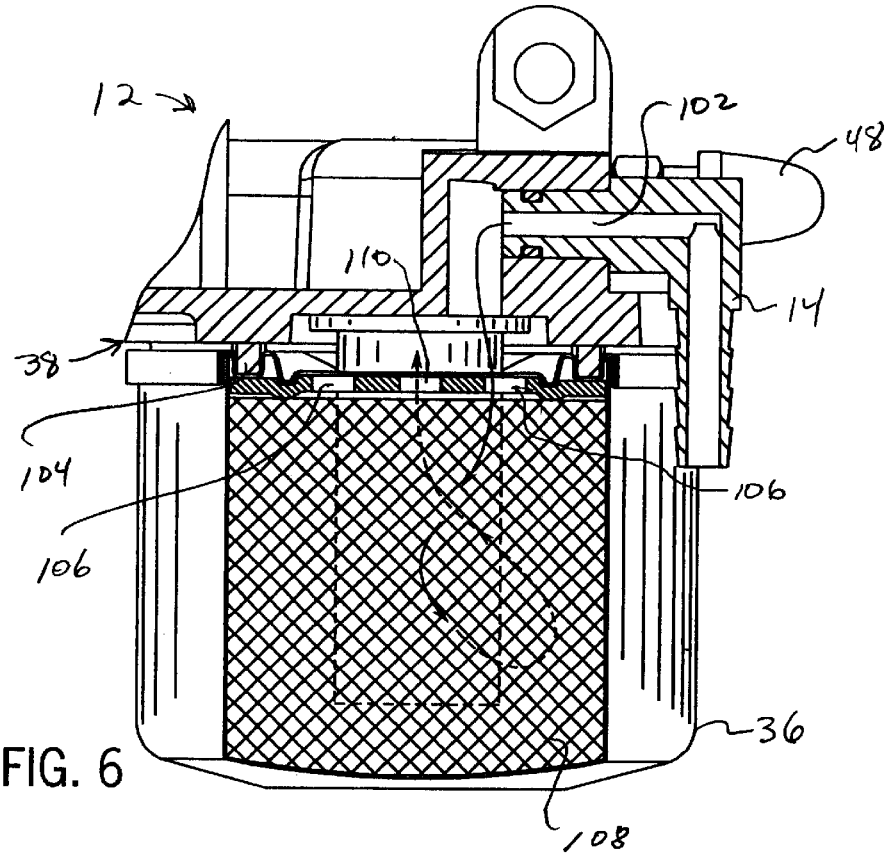
FIG. 6 is a partial cross-section of the oiling system taken along line 6—6 of FIG. 5.
Figure 7:
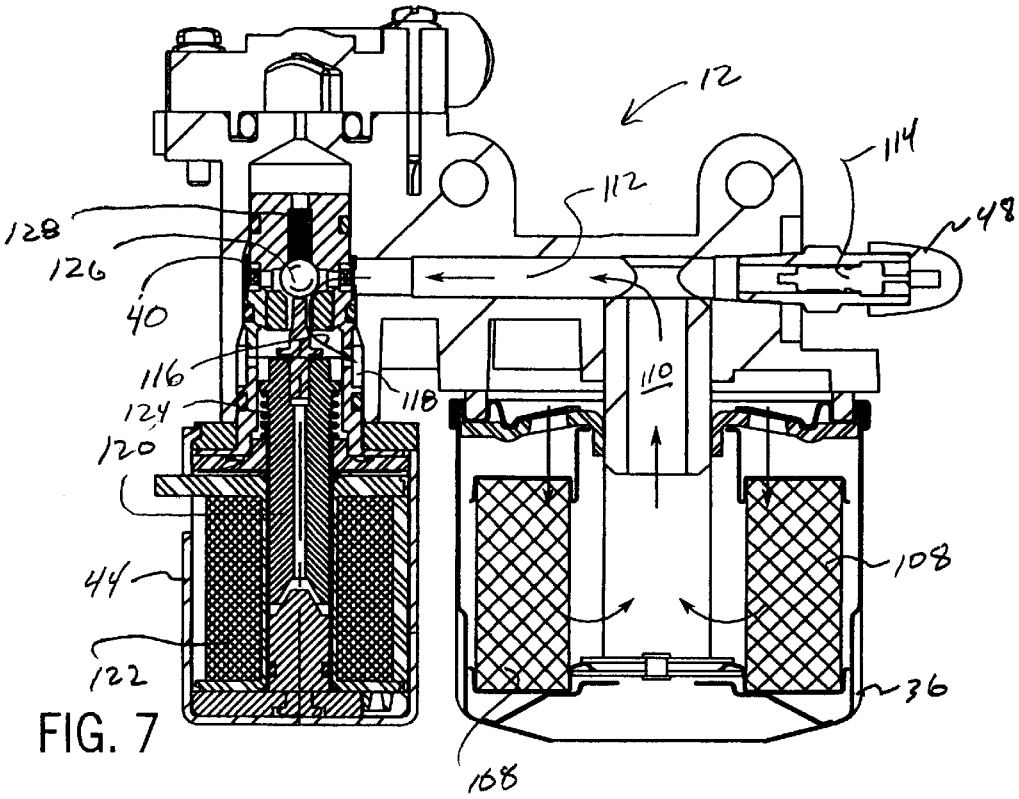
FIG. 7 is a cross-sectional view taken along line 7—7 of FIG. 5.

Referring to FIG. 6, oil is first introduced into the oil inlet port 14 through a first internal passage 102 and is then introduced into the full flow, replaceable oil filter 36. The oil filter is mounted to the oil filter base 38 and sealed therebetween with gasket 104. Oil is introduced into filter 36 through a plurality of openings 106, is filtered in element 108 and discharged through center opening 110. As shown in FIG. 7, once discharged through center opening 110, the oil enters a second internal passage 112 and is routed to the oil flow control section 40.

The test port 48 is in fluid communication with the second internal passage 112 and is equipped with a Schraeder valve 114 to test the oil pressure on the back side of filter 36. The Schraeder valve 114 thus provides a point to acquire an accurate reading of the oil pressure as it is presented through the system.

As indicated by arrow 116, oil is then routed to a third internal passage 118 when solenoid 44 is not activated. Solenoid 44 includes an internal plunger 120, magnet 122 and return spring 124 and is constructed in a known manner. The oil flow control section 40 includes a check ball 126 and a pressure spring 128 which moves downwardly when the solenoid is activated, which pulls plunger 124 downwardly and closes the oil path indicated by arrow 116 when oil is diverted to the engine.

Figure 8:
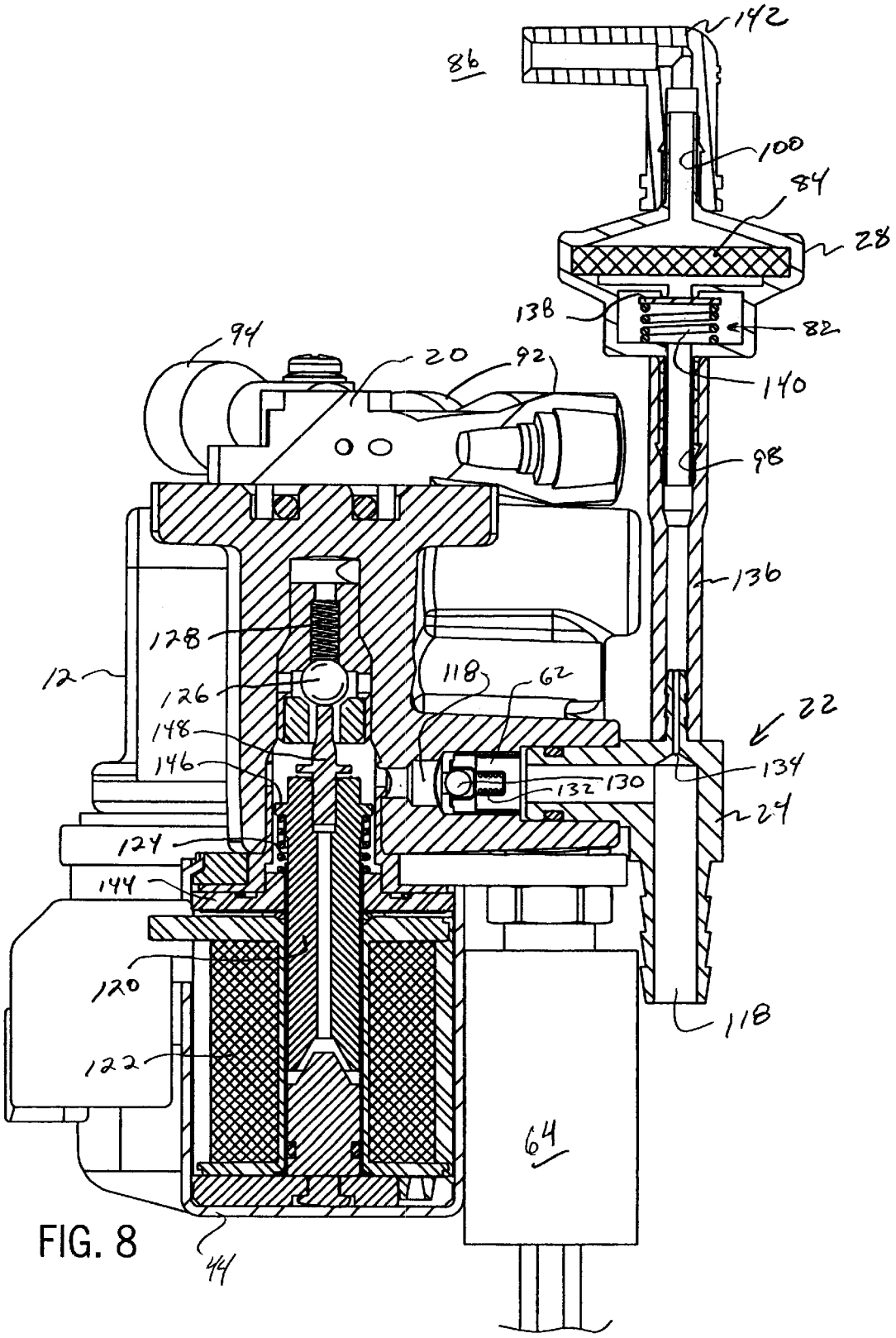
FIG. 8 is a partial cross-sectional view taken along 8—8 of FIG. 5.

Referring now to FIG. 8, the return oil path through solenoid 44 is shown. The oil return port 22, which includes the tee-connector 24, is in fluid communication with the third internal passage 118 through a pressure regulator 62. The pressure regulator 62 includes a check ball 130 and pressure spring 132 to regulate the oil pressure in the oil system at a desired level. The tee-connector 24 includes a relatively narrow air inlet passage 134 that is connected with a hose 136 to the vent valve 28. The vent valve 28 includes air filter 84 and check valve 82, which in turn includes a diaphragm 138 and return spring 140. The vent valve 28 is connected to an L-shaped extension hose 142 at its second end 100 to draw air from the atmosphere 86 to displace consumed oil, as previously described. FIG. 8 also shows a more detailed view of solenoid 44 in which plunger 120 is drawn downward when the magnet 122 is energized. The return spring 124, which is positioned between a stationary block 144 and a shoulder 146 of the plunger 120, causes the plunger to return to its upward position when the magnet 122 is de-energized. An extension shaft 148 is positioned within the plunger 120 and extends upward to support the check ball 126 against pressure spring 128 to maintain oil flow around the check ball 126 along the third internal passage 118.

Figure 9:
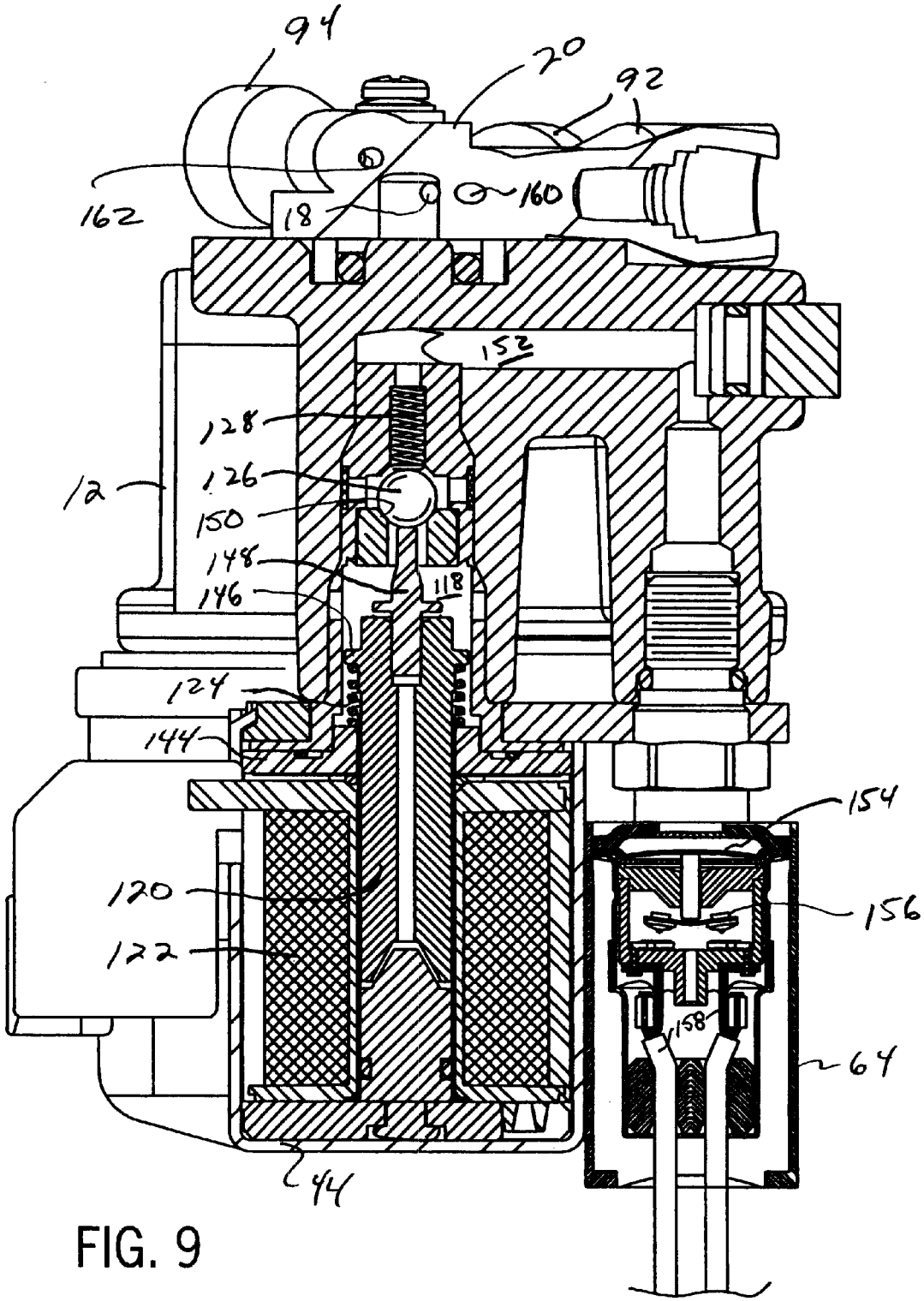
FIG. 9 is a partial cross-sectional view taken along line 9—9 of FIG. 5.
Figure 10:
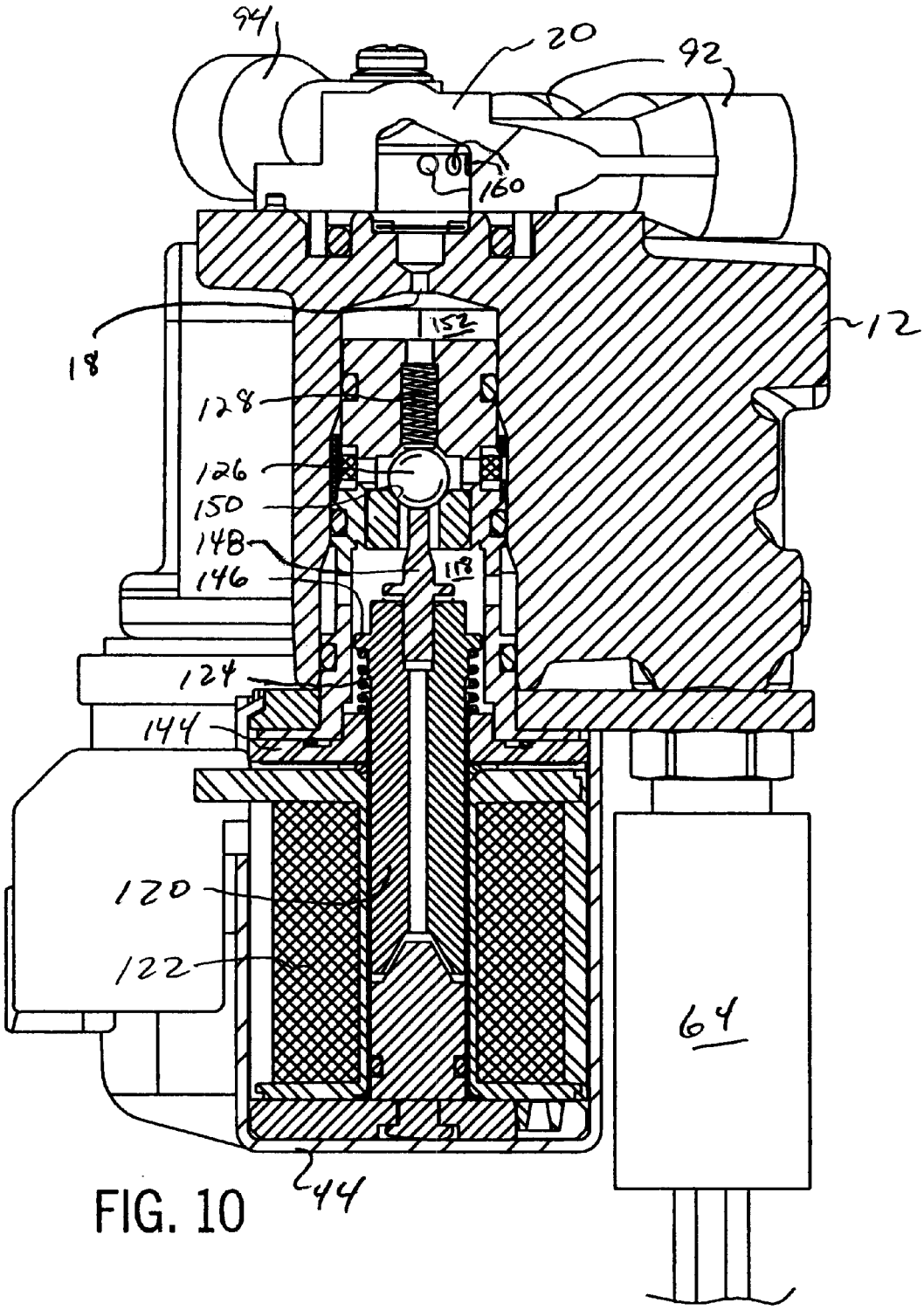
FIG. 10 is a partial cross-sectional view taken along line 10—10 of FIG. 5.

FIG. 9 shows the solenoid 44 in its actuated position with the plunger 120 drawn downwardly within the magnet 122. In this position, the return spring 124 is compressed and the pressure spring 128 is extended causing the check ball 126 against seat 150 which closes oil flow through the third internal passage 118. In this position, oil is routed through a fourth internal passage 152, which is in communication with the pressure sensor 64. Pressure sensor 64 is threadedly engaged in housing 12 and is constructed in a known manner having a pressure diaphragm 154 connected to a pair of contacts 156 that operate to close an electrical path between contact leads 158 which are connected to the ECU. The fourth internal passage 152 is also in fluid communication with the oil outlet 18 of FIG. 10 to supply oil to a number of passages 160 in the distribution manifold 20 to supply oil to the cylinder outlet housings 92 and then to each cylinder of the two-stroke engine. Oil is also supplied by oil outlet 18 to passage 162, FIG. 9, to supply oil through the fuel system oiling outlet housing 94 which leads to the fuel system. Internal passage 162 is at the highest point to purge any air from the oil system.

Figure 11:
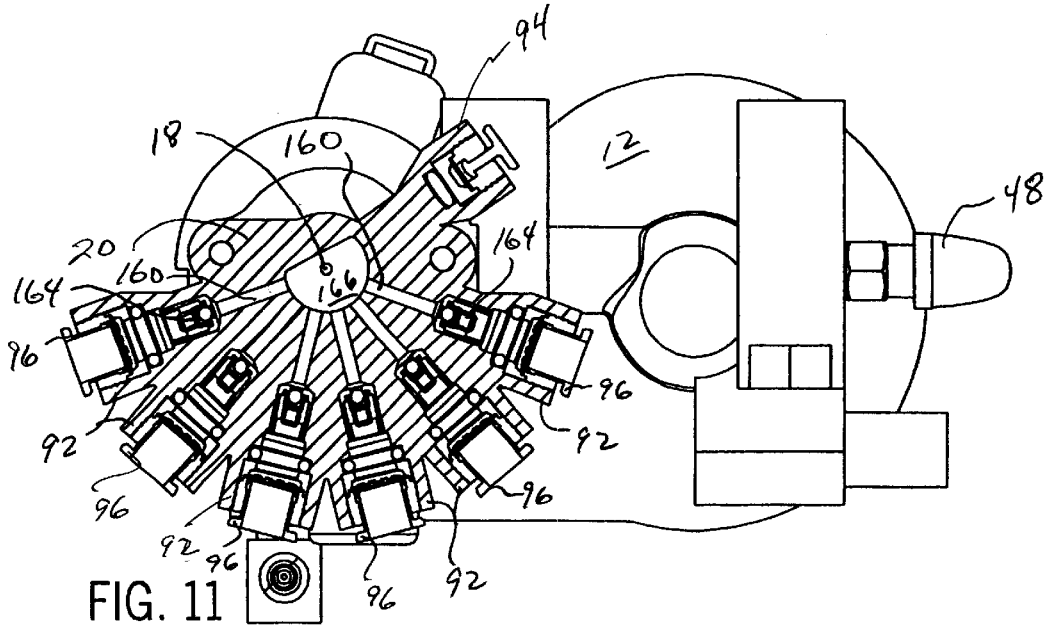
FIG. 11 is a partial cross-sectional view taken along line 11—11 of FIG. 4.

FIG. 11 shows a cross-section of the distribution manifold 20 taken along line 11—11 of FIG. 4 showing the distribution manifold mounted to the oil system housing 12. The cross-section shows oil outlet 18 opening into a D-shaped domed chamber 166 that feeds oil to each of the passages 160 equally. Each of the passages 160 include a check valve 164 within the cylinder outlet housings 92, and each of the outlet housings 92 include a push-to-connect fitting 96, such as the Legris Carstick® fitting made by Legris, Inc. Since the fuel system outlet housing 94 is at a higher elevation than the other outlet housings 92, the upper passageway is not shown. However, passageway 162 for the fuel system outlet housing 94 is at the highest elevation to intersect with a high point of the dome chamber 166. As previously described, this allows any air in the oil system to purge through outlet housing 94 which leads to the fuel system, and once in the fuel system, the air is purged through a fuel separator.

Figure 12:
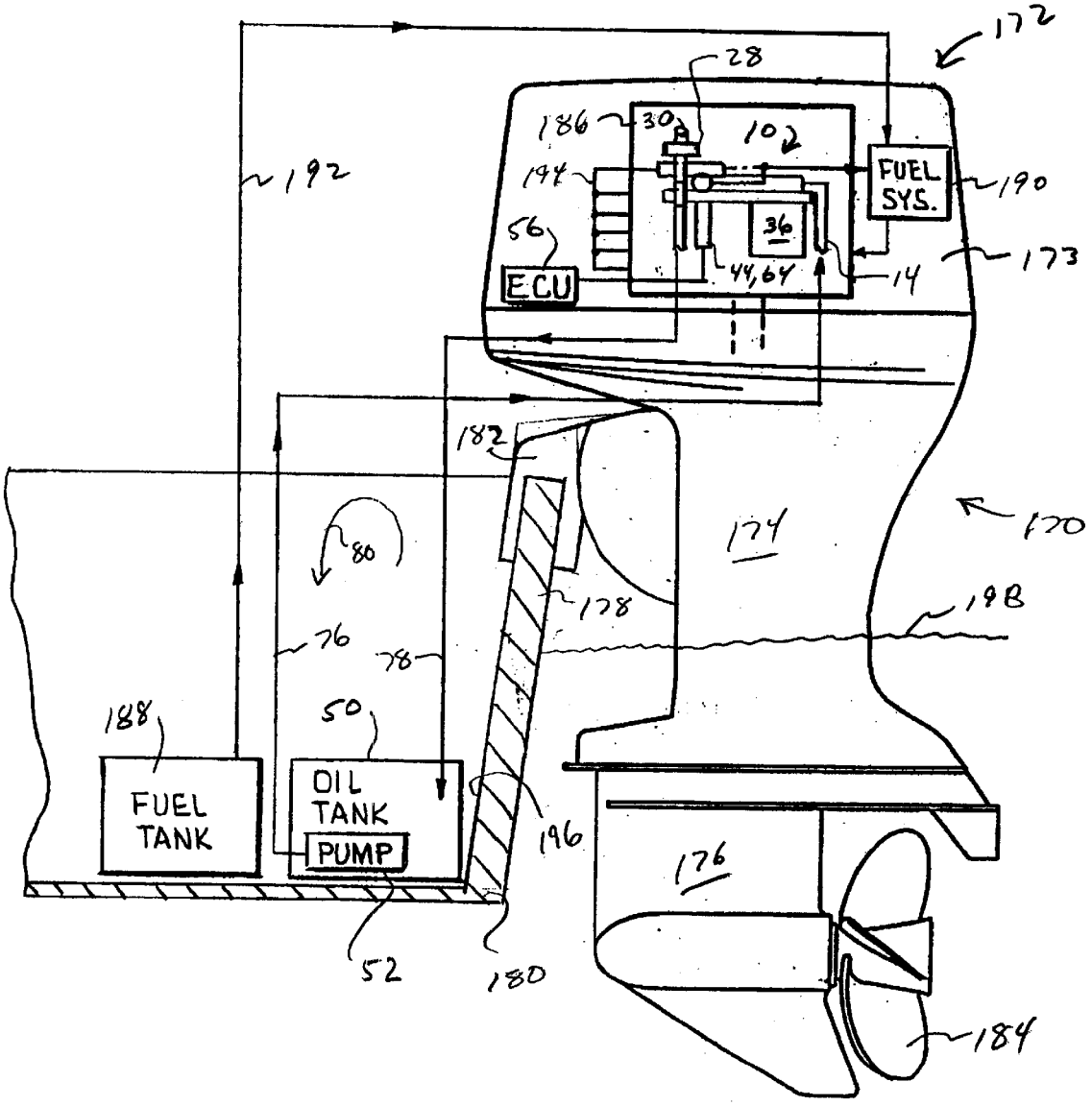
FIG. 12 is a schematical illustration of the oiling system shown in FIGS. 1–10 incorporated into an outboard motor and boat combination.

FIG. 12 shows an operating environment for the present invention herein described. However, it will be appreciated by those skilled in the art that the present invention is equally applicable for use with other types of engines and applications. FIG. 12 shows an outboard motor 170 having a power head 172 enclosed in an upper cowl 173, a mid-section 174, and a lower gear case 176. The outboard motor 170 is mounted to a transom 178 of a boat 180 by a transom mounting bracket 182. The outboard motor 170 includes a propeller 184 extending rearward from the lower gear case 176 to propel the boat 180 through the water. The powerhead 172 includes a two-stroke internal combustion engine 186 controlled by the ECU 56. A fuel tank 188 supplies fuel to the fuel system 190 through a pickup line 192, as is known.

As described with reference to FIG. 2, the oil reservoir 50 pumps oil via pump 52 to the inlet 14 and after filtering through filter 36, the oil is re-circulated through the closed loop 80 until the solenoid 44 is activated by the ECU 56 which diverts lubricant to each of the cylinders 194 and the fuel system 190. As lubricant is withdrawn and consumed from the oil reservoir 50, vent 28 cracks open to intake air and displace the oil consumed in the reservoir 50. Preferably, the oil reservoir is located in a bilge section 196 of the boat 180, which is below the water line 198. It is also preferred that the open end 30 of the vent valve 28 is at an elevation well above the water line 198 to avoid the introduction of water into the oil reservoir 50.

Accordingly, the present invention also includes a method of venting an oil reservoir of an outboard motor that includes providing a ventless oil reservoir, routing lubricant from the ventless oil reservoir through an oil pump to an oil system, and back to the ventless oil reservoir in a closed loop. The method next includes periodically opening the closed loop in the oil system to draw and use lubricant from the ventless oil reservoir. The method provides a vent valve remote from the ventless oil reservoir at an elevation higher than that of the ventless oil reservoir. The vent valve automatically opens when lubricant is consumed to displace the consumed lubricant with air in the ventless oil reservoir.

The present invention has been described in terms of the preferred embodiment, and it is recognized that equivalents, alternatives, and modifications, aside from those expressly stated, are possible and within the scope of the appending claims.

What is claimed is:

1. An outboard motor comprising:

a two-stroke internal combustion engine;

a water propulsion unit in operable association with the two-stroke intetnal combustion engine to propel the outboard motor;

an automatic oil injection system to lubricate the two-stroke internal combustion engine;

an oil system housing having an oil inlet, an oil outlet, and a replaceable oil filter threadedly engaged to the oil system housing to filter lubricant received from the oil inlet; and a pressure regulator within a lubricant return path and an oil pressure sensor in fluid communication with the oil outlet.

2. The outboard motor of claim 1 further comprising an oil reservoir having therein an oil pump to supply lubricant to the oil inlet of the oil system housing.

3. The outboard motor of claim 2 further comprising a boat having a transom to mount the outboard motor thereon, and wherein the oil reservoir is located in a bilge section of the boat.

4. The outboard motor of claim 1 further comprising a solenoid mounted to the oil system housing to control lubricant flow through the automatic oil injection system.

5. The outboard motor of claim 4 wherein the oil system housing includes an oil return and wherein a normally open position of the solenoid routes lubricant from the oil filter to the oil return and when the solenoid is activated, lubricant is routed to the oil outlet.

6. The outboard motor of claim 1 further comprising a distribution manifold in communication with the oil outlet of the oil system housing to distribute lubricant to each cylinder of the two-stroke internal combustion engine.

7. The outboard motor of claim 6 wherein the distribution manifold includes a fuel system oiling outlet and a plurality of cylinder oiling outlets and wherein the fuel system oiling outlet is at an elevation higher than that of each of the cylinder oiling outlets.

8. The outboard motor of claim 1 further comprising a vent valve having two ends, wherein one end is open to atmospheric pressure and another end is in communication with an oil return port of the oil system housing, and wherein the open end is at a relatively high elevation with respect to the outboard motor.

9. The outboard motor of claim 8 further comprising a remotely located oil reservoir connected to the oil inlet and the oil return port of the oil system housing, wherein the remotely located oil reservoir does not contain a ventilation means such that a path from the oil inlet, through the remotely located oil reservoir, and to the oil return port form a closed ventless system such that the remotely located reservoir is submersible and the vent valve provides air displacement for lubricant drawn from the remotely located oil reservoir.

10. An oiling system for a two-stroke engine comprising:

an oil system housing having an oil inlet, an oil outlet, an oil return, and a threaded stud extending therefrom;

a replaceable oil filter threadedly engaged to the threaded stud of the oil system housing; and a remotely located oil reservoir and an oil pump to pump lubricant to the oil inlet and through the replaceable oil filter.

11. The oiling system of claim 10 further comprising:

a solenoid to control lubricant flow from the oil inlet to one of the oil outlet and the oil return within the oil system housing.

12. The oiling system of claim 11 wherein the oil system housing includes an oil return and wherein a normally open position of the solenoid routes lubricant from the oil filter to the oil return and a closed position of the solenoid routes lubricant to the oil outlet.

13. The oiling system of claim 10 further comprising a distribution manifold in communication with the oil outlet of the oil system housing to distribute lubricant to each cylinder of the two-stroke engine.

14. The oiling system of claim 13 wherein the distribution manifold includes a fuel system oiling outlet and a plurality of cylinder oiling outlets and wherein the fuel system oiling outlet is at an elevation higher than that of each of the cylinder oiling outlets.

15. The oiling system of claim 10 wherein the oil system housing includes a pressure regulator within a lubricant return path and an oil pressure sensor in fluid communication with the oil outlet.

16. The oiling system of claim 10 further comprising a vent valve having two ends, wherein one end is open to atmospheric pressure and another end is in communication with the oil return of the oil system housing and wherein the open end is at a relatively high elevation within the outboard motor.

17. The oiling system of claim 10 further comprising a test port in fluid communication with an output side of the replaceable oil filter.

18. The oiling system of claim 10 wherein the oil pump is located in the remotely located oil reservoir, and the remotely located oil reservoir is located in a boat.

19. An oil system housing comprising:

an oil inlet port in communication with a first internal passage;

an oil filter base to replaceably receive an oil filter thereon such that lubricant from the first internal passage is directed into the oil filter and returned to a second internal passage of the oil system housing;

an oil return port in communication with a third internal passage of the oil system housing;

an oil outlet port in communication with a fourth internal passage of the oil system housing; and a solenoid chamber to receive a solenoid therein to toggle lubricant flow from the second internal passage to one of the third and fourth passages.

20. The oiling system housing of claim 19 incorporated into a two-stroke outboard marine engine.

21. The oiling system housing of claim 20 further comprising a boat and an oil reservoir located in the boat, the oil reservoir having associated therewith an oil pump connected to the oil inlet port to supply lubricant thereto.

22. The oiling system housing of claim 19 further comprising a distribution manifold in fluid communication with the oil outlet port to distribute lubricant to each cylinder of a two-stroke engine, wherein the distribution manifold includes a fuel system oiling outlet and a plurality of cylinder oiling outlets and wherein the fuel system oiling outlet is at an elevation higher than that of each of the cylinder oiling outlets.

23. The oiling system housing of claim 19 further comprising:

a pressure regulator within the third internal passage to regulate oil pressure within the oil system housing; and an oil pressure sensor in fluid communication with the oil outlet port and the fourth internal passage.

24. The oiling system housing of claim 19 further comprising a vent valve having two ends, wherein one end is open to atmospheric pressure and another end is in communication with the oil return port of the oil system housing and wherein the open end is at a relatively high elevation within an engine cowl section of an outboard motor.

25. An outboard motor comprising:

a two-stroke internal combustion engine;

a water propulsion unit in operable association with the two-stroke internal combustion engine to propel the outboard motor, an automatic oil injection system to lubricate the two-stroke internal combustion engine;

an oil system housing having an oil inlet, an oil outlet, and a replaceable oil filter threadedly engaged to the oil system housing to filter lubricant received from the oil inlet;

a vent valve having two ends, wherein one end is open to atmospheric pressure and another end is in communication with an oil return port of the oil system housing, and wherein the open end is at a relatively high elevation with respect to the outboard motor; and a remotely located oil reservoir connected to the oil inlet and the oil return port of the oil system housing, wherein the remotely located oil reservoir does not contain a ventilation means such that a path from the oil inlet, through the remotely located oil reservoir, and to the oil return port form a closed ventless system such that the remotely located reservoir is submersible and the vent valve provides air displacement for lubricant drawn from the remotely located oil reservoir.

26. An outboard motor comprising:

a two-stroke internal combustion engine;

a water propulsion unit in operable association with the two-stroke internal combustion engine to propel the outboard motor;

an automatic oil injection system to lubricate the two-stroke internal combustion engine;

an oil system housing having an oil inlet, an oil outlet, and a replaceable oil filter threadedly engaged to the oil system housing to filter lubricant received from the oil inlet; and a distribution manifold in communication with the oil outlet of the oil system housing to distribute lubricant to each cylinder of the two-stroke internal combustion engine, the distribution manifold including a fuel system oiling outlet and a plurality of cylinder oiling outlets and wherein the fuel system oiling outlet is at an elevation higher than that of each of the cylinder oiling outlets.

* * * * *